US008122956B2

(12) United States Patent
Shammai et al.

(10) Patent No.: US 8,122,956 B2
(45) Date of Patent: Feb. 28, 2012

(54) MAGNETIC STIRRER

(75) Inventors: Michael Shammai, Houson, TX (US); Robert J. Gordon, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 253 days.

(21) Appl. No.: 12/497,470

(22) Filed: Jul. 2, 2009

(65) Prior Publication Data

US 2010/0000731 A1 Jan. 7, 2010

Related U.S. Application Data

(60) Provisional application No. 61/077,921, filed on Jul. 3, 2008.

(51) Int. Cl.
*E21B 49/08* (2006.01)
*B01F 15/00* (2006.01)
*B01F 13/08* (2006.01)

(52) U.S. Cl. ..... 166/264; 166/66.5; 166/100; 166/107; 166/162; 166/177.7; 366/273; 175/58; 73/152.23; 73/152.24; 73/152.25; 73/152.26; 73/152.27; 73/152.28

(58) Field of Classification Search ..... 166/264, 166/66.5, 100, 107, 162, 177.7; 366/273; 175/58; 73/152.23–152.28
See application file for complete search history.

(56) References Cited

U.S. PATENT DOCUMENTS 4,154,300 A 5/1979 Vinatieri et al.
4,508,169 A 4/1985 Mut et al.
4,815,536 A 3/1989 Prendergast et al.
4,817,711 A 4/1989 Jeambey
4,834,545 A * 5/1989 Inoue et al. ..... 366/138
4,916,946 A 4/1990 Cameron
4,940,088 A * 7/1990 Goldschild ..... 166/109
4,941,350 A 7/1990 Schneider
5,228,345 A 7/1993 Vales
5,335,542 A 8/1994 Ramakrishnan et al.
5,335,724 A 8/1994 Venditto et al.
6,247,358 B1 6/2001 dos Santos
6,393,906 B1 5/2002 Vityk et al.
6,490,916 B1 12/2002 Goodwin et al.
6,651,739 B2 11/2003 Arndt et al.
6,659,175 B2 12/2003 Malone et al.
6,688,390 B2 * 2/2004 Bolze et al. ..... 166/264
6,691,780 B2 2/2004 Nguyen et al.
6,725,926 B2 4/2004 Nguyen et al.
7,032,662 B2 4/2006 Malone et al.
7,128,142 B2 10/2006 Heathman et al.
7,128,144 B2 10/2006 Fox et al.
7,128,149 B2 10/2006 Heathman et al.
7,246,664 B2 * 7/2007 Shammai et al. ..... 166/264
7,333,892 B2 2/2008 Egermann et al.
7,407,631 B2 * 8/2008 Swon et al. ..... 422/561
7,556,096 B2 7/2009 Vinegar et al.
(Continued)

*Primary Examiner* — Jennifer H Gay
*Assistant Examiner* — Tamatane Aga
(74) *Attorney, Agent, or Firm* — Bracewell & Giuliani LLP

(57) ABSTRACT

A sample tank for receiving and storing sampled connate fluid from a subterranean geological formation. The sample tank includes a piston coaxially disposed within the tank. The piston can be disposed close to the end of the tank where the sampled fluid is introduced into the tank and urged along the length of the tank as sampled fluid is added to the tank. The piston includes an agitator for mixing the fluid and keeping particulates suspended within the fluid. The agitator includes a magnetic member, and is rotated by applying a varying electromagnetic field to the member.

10 Claims, 2 Drawing Sheets

U.S. PATENT DOCUMENTS 7,575,053 B2 8/2009 Vinegar et al.
7,621,325 B2 * 11/2009 Shammai et al. ..... 166/264
7,845,405 B2 * 12/2010 Villareal et al. ..... 166/264
2005/0238540 A1 * 10/2005 Swon et al. ..... 422/99
2007/0041269 A1 * 2/2007 Engel ..... 366/273
2007/0114021 A1 * 5/2007 Brown et al. ..... 166/250.1

* cited by examiner

MAGNETIC STIRRER

CROSS-REFERENCE TO RELATED APPLICATIONS

The present application relates to U.S. provisional application 61/077,921 filed on Jul. 3, 2008, the entire specification of which being herein incorporated by reference.

BACKGROUND

1. Field of the Disclosure

The present disclosure relates generally to the field of exploration and production of hydrocarbons from wellbores. More specifically, the present disclosure relates to an apparatus used for storing connate fluid sampled from within a subterranean geological formation.

2. Description of Related Art

The sampling of fluids contained in subsurface earth formations provides a method of testing formation zones of possible interest by recovering a sample of any formation fluids present for later analysis in a laboratory environment while causing a minimum of damage to the tested formations. The formation sample is essentially a point test of the possible productivity of subsurface earth formations. Additionally, a continuous record of the control and sequence of events during the test is made at the surface. From this record, valuable formation pressure and permeability data as well as data determinative of fluid compressibility, density and relative viscosity can be obtained for formation reservoir analysis.

Early formation fluid sampling instruments were not fully successful in commercial service because they were limited to a single test on each trip into the borehole. Later instruments were suitable for multiple testing; however, the success of these testers depended to some extent on the characteristics of the particular formations to be tested. For example, where earth formations were unconsolidated, a different sampling apparatus was required than in the case of consolidated formations.

Downhole multi-tester instruments have been developed with extensible sampling probes for engaging the borehole wall at the formation of interest for withdrawing fluid samples therefrom and measuring pressure. In downhole instruments of this nature it is typical to provide an internal draw-down piston which is reciprocated hydraulically or electrically to increase the internal volume of a fluid receiving chamber within the instrument after engaging the borehole wall. This action reduces the pressure at the instrument/formation interface causing fluid to flow from the formation into the fluid receiving chamber of the tool or sample tank. Heretofore, the pistons have accomplished suction activity only while moving in one direction. On the return stroke the piston simply discharges the formation fluid sample through the same opening through which it was drawn and thus provides no pumping activity. Additionally, such unidirectional piston pumping systems can only move the fluid being pumped in a single direction, resulting in a slowly operating sampling system.

As shown in FIG. 1, the sampling of subterranean formation fluid typically involves the insertion of a sampling tool 10 within a wellbore 5 that intersects the subterranean formation 6. Generally the tool 10 is inserted on the end of a wireline 8 or other armored cable, but can also be disposed within the wellbore 5 on tubing (not shown). When wireline 8 is used, it is typically maintained on a spool from which the tool 10 is reeled within the wellbore 5. When it is established that the tool 10 is adjacent to the region of the formation 6 where sampling is to occur, rotation of the spool is ceased thereby suspending the tool 10 at the proper depth within the wellbore 5. Upon suspending the tool 10 at the predetermined downhole depth, an urging means 12 is extended from the tool 10 that pushes the tool 10 against the inner diameter of the wellbore 5 on the side of the tool 10 opposite to the urging means 12. A probe 14 provided on the tool 10 opposite to the urging means 12 pierces the wellbore 5 inner diameter or wall extending a small distance into the formation 6. The probe 14 includes a passage within its body allowing for fluid flow through its inner annulus. Within this annulus of the probe 14, subterranean fluid can flow from the formation 6 to within the tool 10 for storage and subsequent analysis.

SUMMARY

The present disclosure involves a subterranean formation fluid sample storage tank that includes, a housing, a piston disposed within the housing, a fluid agitator assembly couplable with the piston, and a coil assembly in electromagnetic cooperation with the agitator assembly. Also disclosed herein is a method of storing fluid from a subterranean geological formation in a storage tank having a fluid agitation system. In an example, the method includes urging subterranean formation fluid from a subterranean formation into the storage tank, generating a phase changing electromagnetic field, and activating the fluid agitation system by applying the electromagnetic field to the fluid agitation system.

BRIEF DESCRIPTION OF THE SEVERAL VIEWS OF THE DRAWING

Some of the features and benefits of the present disclosure having been stated, others will become apparent as the description proceeds when taken in conjunction with the accompanying drawings, in which.

Figure 3:
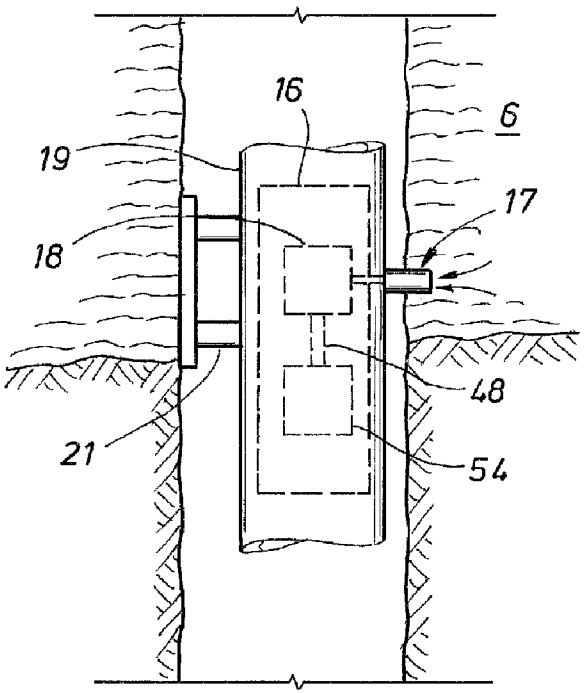
FIG. 3 is a side partial sectional view of an example of a portion of a sampling tool in a wellbore.
Figure 1:
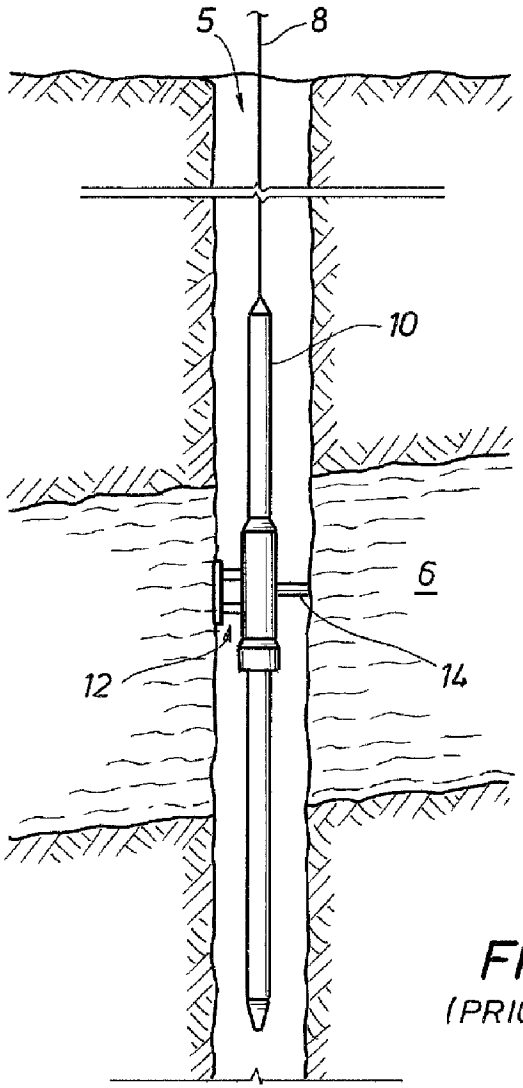
FIG. 1 (PRIOR ART)
FIG. 1 depicts in a side partial sectional view an example of a prior art sampling tool disposed within a wellbore.

While the subject device and method will be described in connection with the preferred embodiments but not limited thereto. On the contrary, it is intended to cover all alternatives, modifications, and equivalents, as may be included within the spirit and scope of the present disclosure as defined by the appended claims.

DETAILED DESCRIPTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be through and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. Accordingly, the improvements herein described are therefore to be limited only by the scope of the appended claims.

The present disclosure involves a novel sampling system useful for obtaining and collecting connate fluid resident within a subterranean geological formation. One embodiment of a sampling system 16 in accordance with the novel aspects disclosed herein is illustrated in partial cross sectional view in FIG. 2. Here, the sampling system 16 is comprised of a pumping device 18 in fluid communication with a tank 54. The pumping device 18 comprises a pump 26 driven by a hydraulic system 22, where the pumping device 18 draws connate fluid from the formation 16 and delivers it to the tank 54.

Figures 2, 2A:
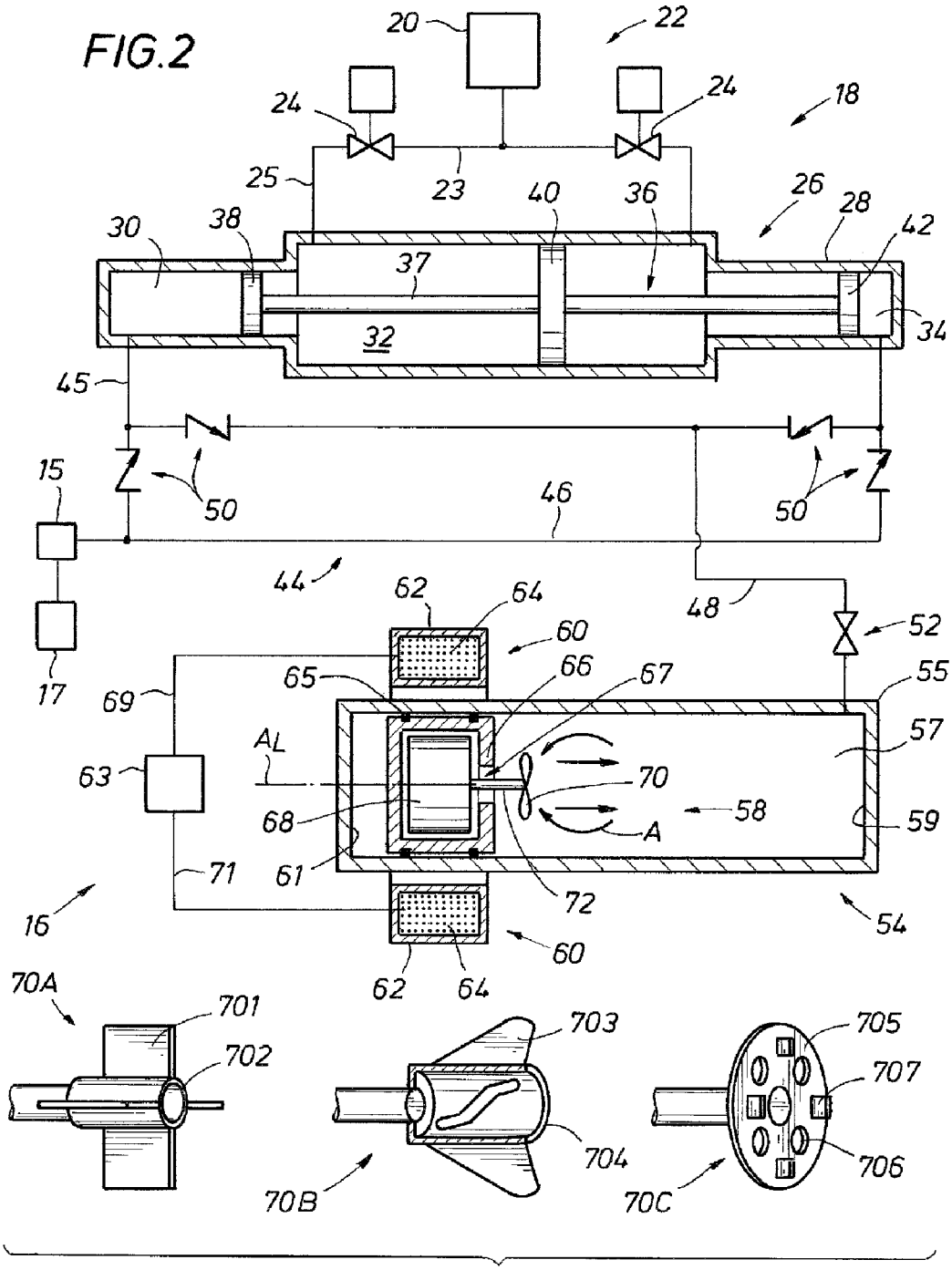
FIG. 2 schematically represents in a side sectional view an embodiment of a pumping system with a sample tank in accordance with the present disclosure.
FIG. 2A illustrates in perspective views alternate examples of agitators.

More specifically, the hydraulic system 22 of the embodiment of FIG. 2 drives the pumping device 18 by reciprocating a piston 36 housed within the pump 26. The piston 36 comprises a rod 37 running coaxial within the pump housing 28 having an inner plunger 40 secured proximate to the midpoint of the rod 37. The inner plunger 40 should be substantially coaxial with the rod 37 and have an outer diameter that extends outward into sealing contact with the inner diameter of the pump housing 28. Disposed at the ends of the rod 37 are a first end plunger 38 and a second end plunger 42. The plungers 38, 42 should also have outer diameters that extend outward into sealing contact with the inner circumference of the pump housing. In the embodiment shown in FIG. 2, the inner plunger 40 has a diameter greater than the diameter of both the first and second end plungers 38, 42. However these diameters can be substantially the same or the inner plunger diameter can be less than the outer plunger diameters.

Reciprocation of the piston 36 of the embodiment shown is produced by selectively introducing pressurized hydraulic fluid on alternate sides of the inner plunger 40 thereby urging the inner plunger 40 back and forth inside a chamber 32 shown within the inside of the pump housing 28. The pressurized hydraulic fluid is delivered to the pump 26 from the hydraulic fluid source 20 via the hydraulic circuit 22. The hydraulic fluid source 20 can be a motor driven unit disposed downhole, or proximate the borehole entrance. Lines 23, 25 respectively connect the hydraulic fluid source 20 to the valves 24 and the valves 24 to the pump housing 28. The fluid is selectively delivered to opposing sides of the inner plunger 40 by alternatingly opening/closing the automatic valves 24. Reciprocating the piston 36 produces in and out movement of the outer plungers 38, 42 within their respective recesses 30, 34 correspondingly reducing pressure within the respective recess from which the plunger is retreating.

The pumping system 18 utilizes the low pressure within the recesses 30, 34 to induce connate fluid into the pump 26 from the formation 6. As shown, a probe connector 15 is in fluid communication with a probe 17 that is selectively in communication with formation fluid. As discussed above, reciprocating the piston 26 within the housing 28 draws formation (or connate) fluid through the probe 17 and probe connector 15 to a connected inlet line 46. A branch 45 depending from the inlet line 46 delivers formation fluid to chamber 30; inlet line 46 delivers formation fluid to chamber 34. Check valves 50 in the branch 45 and inlet line 46 prevent backflow to the connector 15 while allowing flow to the chambers 30, 34.

Subsequent piston 36 reciprocation backstrokes the outer plungers 38, 40 into a respective chamber 30, 34 and pushes formation fluid from the chamber 30, 34 into an outlet line 48. As schematically illustrated, the outlet line 48 includes leads connecting to the branch 45 and inlet line 46 downstream of the check valves 50. Thus fluid being discharged from the chambers 30, 34 first reenters the branch 45 and inlet line 46 then flows to the outlet line 48. The check valves 50 block backflow into these lines thus routing discharged flow from the pump 26 to the outlet line 48. Optionally, the outlet line 48 could directly connect to the chambers 30, 34 instead of the branch 45 or inlet line 46. Optional check valves 50 are shown in the outlet line 48 oriented to direct outlet flow through the outlet line 48 to a storage tank 54 coupled on the outlet line 48 terminal end.

The outlet line 48 includes a block valve 52 for selectively isolating the tank 54 from the pumping system 26. This isolation may be desired for repairs and can also be utilized when removing the sampled connate fluid from within the tank 54. In the embodiment of the tank 54 shown in FIG. 2, the tank 54 comprises an outer housing 55 with a substantially hollowed out middle section within thereby forming a plenum 57. Disposed within the plenum 57 is a piston assembly 58 that includes a piston body 66, a magnetic member 68 disposed within the piston body 66. Also shown in the plenum 57 is an agitator 70 connected by a shaft 72 to the magnetic member 68. The agitator 70 may be any suitable device configured to move or otherwise agitate fluid within the tank 54. The agitator 70 may be configured to move axially, rotationally or a combination thereof within the tank 54.

In one non-limiting embodiment, the agitator 70 includes a propeller-shaped end portion that may be rotated and or translated to agitate the fluid. Examples of agitator embodiments are provided in a perspective view in FIG. 2A. The agitator 70A includes rectangular vanes 701 projecting radially outward from a cylindrical hub 702. Agitator 70B, which is shown in a partial sectional view, includes a cylindrical body 704 through which fluid can pass. Vanes 703 are shown provided on the inner and outer surfaces of the body 704. In another embodiment, agitator 70C includes a disk-shaped member 705 having holes or openings 706 formed therethrough and projections 707 attached on the member 705 surface. The agitator 70 may be formed from a rigid material, from a pliable material to prevent fracture and/or permanent deformation if pressed against a tank end wall 59, or the agitator 70 may be formed of a combination of materials.

The piston body 66 is moveable in the tank 54 along its longitudinal axis $A_L$; and can have outer dimensions substantially matching the plenum 57 inner dimensions. Optionally the piston body 66 may include one or more seals 65 for sealing between the piston body 66 and plenum 57. In the embodiment shown, the magnetic member 68 is freely rotatable within the piston body 66. An opening 67 shown formed through the piston body 66 is substantially coaxial to the tank 54 longitudinal axis $A_L$. The shaft 72 is attached on one end of the magnetic member 68 and it extends outward from the magnetic member 68 through the opening 67 for attachment on its other end to the agitator 70.

A coil assembly 60 shown circumscribing the tank 54 outer surface includes a coil housing 62 with coil leads 64 wound therein. In an example, a power source 63 is shown having leads 69, 71 connecting to the coil assembly 60. The power source 63, which can selectively energize the coil assembly 60, can be provided downhole with the sampling system 16 or at the surface. The coil assembly 60 is selectively moveable along the tank 54 along a path substantially parallel with tank 54 longitudinal axis $A_L$. Optionally, the coil housing 62 may be comprised of a ferrous material magnetically coupled to the magnetic member 68 that can couple the coil assembly 60 and piston assembly 58 so they move together along the tank's 54 length. Magnetic member 68 embodiments include a permanent magnet and an electromagnet.

FIG. 3 illustrates an example of operation where the sampling system 16 is deployed in a wellbore 5 within a carrier 19 and an urging means 21 pushes the carrier 19 so the probe 17 pierces the formation 6. Fluid, represented by arrows, is then drawn into the probe 17 by activating the pump system 18 and is pumped to the tank 54. During, or prior to deployment in the wellbore 5, the piston assembly 58 may be positioned adjacent the tank end wall 59. Fluid pumped to the tank 54 is deposited in the plenum 57 where it accumulates between piston body 66 and end wall 59 forcing the piston assembly 58 towards the opposite end wall 61. As noted above, magnetically coupling the magnetic member 68 and coil assembly 60 causes the coil assembly 60 to "track" the piston assembly 58 as it moves within the tank 54. Since fluid addition in the tank 54 affects piston assembly 58 position, coil assembly 60 position can be an indicator of fluid volume in the tank 54.

Another novel aspect of the present disclosure is externally driving the agitator 70. In one embodiment of use, the power source 63 selectively provides electrical energy in the form of power, voltage, and/or current to the coil assembly 60 via lead(s) 69, 71. The electrical energy energizes the coil leads 64 to create an electromagnetic field around and in the tank 54, including the magnetic member 68. The electromagnetic field rotates the magnetic member 68, attached shaft 72, and agitator 70. Thus in one example of use, the driver for rotating the agitator 70 is an electromagnetic field. Other example drivers for the agitator 70 include the coil assembly 60 and the coil assembly 60 and power source 63. The agitator 70 rotation agitates the connate fluid in the plenum 57 dispersing and suspending particulates in the fluid to prevent silting and particulate precipitation within the tank 54. Optionally, agitator 70 operation circulates the fluid as illustrated by the arrows A. The agitator 70 can operate continuously or intermittently.

The term "carrier" as used herein means any device, device component, combination of devices, media and/or member that may be used to convey, house, support or otherwise facilitate the use of another device, device component, combination of devices, media and/or member. Exemplary non-limiting carriers include drill strings of the coiled tube type, of the jointed pipe type and any combination or portion thereof. Other carrier examples include casing pipes, wirelines, wireline sondes, slickline sondes, drop shots, downhole subs, bottom hole assemblies, drill string inserts, modules, internal housings and substrate portions thereof.

A "downhole fluid" as used herein includes any gas, liquid, flowable solid and other materials having a fluid property. A downhole fluid may be natural or man-made and may be transported downhole or may be recovered from a downhole location. Non-limiting examples of downhole fluids include downhole fluids can include drilling fluids, return fluids, formation fluids, production fluids containing one or more hydrocarbons, oils and solvents used in conjunction with downhole tools, water, brine and combinations thereof.

The system and method described herein, therefore, is well adapted to carry out the objects and attain the ends and advantages mentioned, as well as others inherent therein. While a presently preferred embodiment has been given for purposes of disclosure, numerous changes exist in the details of procedures for accomplishing the desired results. For example, the agitator 70 can be comprised of a flexible metal, such as stainless steel, as well as sturdy polymeric materials, such as high-density polyethylene. The magnetic member 68 and the agitator 70 could optionally be integrally formed with the piston body 66. The shaft 72 can include magnetic material. In an example of forming a shaft 72 from magnetic material, the magnetic member 68 may not be necessary. These and other similar modifications will readily suggest themselves to those skilled in the art, and are intended to be encompassed within the spirit of the present disclosure and the scope of the appended claims.

What is claimed is:

1. A system for sampling connate fluid from a subterranean formation comprising:

a sample tank in a borehole that intersects the subterranean formation;

a pump having an end in fluid communication with the subterranean formation and an end in fluid communication with the sample tank;

a piston body slidably disposed within a plenum in the sample tank;

an agitator partially housed in the piston body and selectively rotatable within the piston body; and a driver adjacent the sample tank that is magnetically coupled with the agitator and moveable along a path substantially parallel with an axis of the sample tank.

2. The system of claim 1, wherein the driver comprises a coil assembly coupled to a power source.

3. The system of claim 1, further comprising a seal disposed between the piston body and plenum, so that when connate fluid is discharged from the pump into the plenum, the seal defines a pressure barrier that urges the piston body and agitator along the axis of the sample tank and wherein the magnetic coupling between the agitator and the driver urges the driver in the same direction as the piston body.

4. The system of claim 1 wherein said agitator comprises an end disposed in the plenum that is flexibly resilient.

5. A method of sampling connate fluid from a subterranean formation comprising:

providing a sampling assembly comprising a sample tank, a piston body axially slidable within the sample tank, an agitator assembly having a magnetic member mounted in the piston body and rotatable therein in response to an applied magnetic field and having an agitator coupled to the magnetic member and extending outside of the piston body; and a driver disposed adjacent the sample tank that is in selective magnetic coupling with the agitator;

urging fluid into the sample tank from the subterranean formation to a side of the piston body having the agitator; and agitating the fluid by energizing the driver to rotate the agitator.

6. The method of claim 5, wherein the fluid is being agitated as the piston body is urged substantially along a length of the sample tank.

7. The method of claim 5 further comprising retrieving the fluid from the sample tank.

8. The method of claim 5, wherein the driver comprises a coil assembly coaxially circumscribing said tank, the method further comprising driving the agitator by energizing the coil to electromagnetically couple the coil assembly to the magnetic member and rotate the agitator.

9. The method of claim 8, further comprising observing a position of the driver along a length of the sample tank and estimating an amount of fluid in the sample tank based on the observed position of the coil assembly.

10. The method of claim 5, further comprising combining a pump with the sample tank, housing the pump and sample tank in a sonde, inserting the sonde into a borehole intersecting the subterranean formation, and piercing the subterranean formation with a probe to initiate fluid communication between the formation and the pump.

* * * * *